United States Patent [19]

Geadah et al.

[11] 4,040,120

[45] Aug. 2, 1977

[54] ELECTROSTATIC PROTECTION FOR A TELECOMMUNICATIONS TERMINAL APPARATUS

[75] Inventors: Youssef Alfred Geadah; Frank Joseph Vallo, both of Ottawa, Canada

[73] Assignee: Northern Telecom Limited, Montreal, Canada

[21] Appl. No.: 700,957

[22] Filed: June 29, 1976

[51] Int. Cl.[2] ..... H05F 3/02

[52] U.S. Cl. ..... 361/220; 179/100 R; 179/184

[58] Field of Search ..... 317/2 R, 2 B; 179/100 R, 100 D, 179, 184, 186; 361/212, 220

[56] References Cited

U.S. PATENT DOCUMENTS

| | | | |
|---|---|---|---|
| 3,627,930 | 12/1971 | Tolman | 179/100 R |
| 3,711,742 | 1/1973 | Pinkham, Jr. | 317/2 R |
| 3,780,345 | 12/1973 | Earman, Jr. | 317/2 R |

*Primary Examiner*—Gerald Goldberg
*Attorney, Agent, or Firm*—Frank Turpin

[57] ABSTRACT

A telecommunications terminal apparatus, connected to a transmission facility which includes a source of energizing current and an earth connection, is protected from static discharge of the type typically originating with a user. The terminal apparatus includes an ABS housing with one or more apertures therein to facilitate user actuation of various control buttons or keys. The periphery of each aperture is rendered electrically conductive. A low impedance sink such as a remote power supply, earth or a transmission line is connected to the electrically conductive periphery via a variable impedance element, for example a pair of back to back zener diodes. The housing also includes a conductive foot for contact with a supporting surface. The conductive foot is also connected with the conductive periphery of the aperture. In the case where the electronic circuitry includes a CMOS integrated circuit, an anti-latch circuit is included to prevent destruction of the CMOS integrated circuit which could otherwise be induced by a nearby static electrical discharge.

9 Claims, 4 Drawing Figures

ELECTROSTATIC PROTECTION FOR A TELECOMMUNICATIONS TERMINAL APPARATUS

The present invention relates generally to telecommunication terminal apparatus which includes electronic circuitry, and more particularly to means of protection for the electronic circuitry against static electricity discharges.

Telecommunications transmission facilities are terminated with a wide range of various subscriber apparatus, for example from simple telephones to remote computer terminals. In this wide range of apparatus, certain items include electronic circuitry which is interfaced with the user by means of keys, push buttons and the like. The housings for these types of apparatus are usually of an organic plastic material having good electrical insulating properties. However the dielectric strength of most of these materials is insufficient to prevent random and usually unpredictable static electric discharges, typically originating with a user, from being conducted through the terminal apparatus. Static discharges have a wide range of consequential effects depending upon the type of electronic circuitry in the apparatus. For example, discrete circuits including diodes and bipolar transistors tend not to be significantly affected by user generated static discharge. On the other hand, integrated metal oxide silicon (MOS) circuits are more likely to be interrupted in normal operation and sometimes can be effectively destroyed by user generated static discharges. During a user's normal activities, static potentials well in excess of 7 kilovolts, are often generated. This is so particularly during the winter months at higher latitudes where indoor environments tend to be extremely dry. One well known remedy for this problem is that of maintaining sufficient humidity in the operating environment of electronic terminal apparatus to prevent static electricity charges from building up. This remedy is hardly practical however when the terminal apparatus is geographically scattered about, as for example in the case of subscriber apparatus required for the expanding demand for sophisticated telephone business communication systems. Subscriber terminal apparatus for these new telephone systems include operational features which are most economically provided by devices generally referred to as MOS integrated circuits. MOS circuits when associated with transmission lines or real earth ground, as in the case of terminal apparatus, are extremely sensitive to static electric discharges.

A housing for a terminal apparatus usually includes one or more apertures to permit a user to actuate a control device such as a pushbutton or the like. It has been found that a static discharge from the user often carries through the control device, to the input of the electronic circuit and via the electronic circuit to a low impedance sink such as earth, an external power supply or transmission facility.

It has been found that a substantial reduction in operating interruptions and circuit damage are obtained by providing an alternate discharge path, other than through the circuit itself. An alternate discharge path is provided by an electrically conductive material which resides in close proximity to the aperture and the control device, and is connected via a conductive path to the low impedance sink. In one example embodiment, the wall of the aperture includes an electrically conductive material and a variable impedance device is connected in series between the conductive path and the low impedance sink. The variable impedance device responds to a substantial potential difference appearing across its terminals by rapidly switching from a high impedance to a much lower impedance. Hence a static discharge, for example from a user's fingertip, is conducted to the low impedance sink via the impedance device, thereby substantially precluding damage to the electronic circuitry in the terminal apparatus.

Static electric charge can also exist between the terminal apparatus and a supporting surface upon which it rests. A connection between the conductive material and the supporting surface tends to bleed static charge from the supporting surface to the low impedance sink, and it provides a direct electrical connection between a charged user and the supporting surface at the moment the user is about to touch the control device of the terminal apparatus.

Integrated circuitry of the MOS types includes isolating PN junctions formed in the substrate of the integrated circuit. These isolating junctions are reverse biased during normal operation to electrically isolate the individual field effect transistors in the substrate, one from the other. Under certain input and output current conditions induced externally, as for example by static discharge, the isolating PN junctions become forward biased and in combination with each other assume a conductive stable state similar to that of a silicon controlled rectifier (SCR). This occurrence is referred to as a latch-up condition. In the latch-up condition the power supply becomes connected to ground directly through the forward biased isolating junctions in the integrated circuit and the resulting current typically causes sufficient heating in the substrate to destroy the integrated circuit. In complementary MOS circuits (CMOS), normal average operating circuits are very low and relatively constant. The latch-up condition is conveniently avoided by inserting a low AC impedance current limiter between a power supply and the CMOS integrated circuit to prevent a current flow which could sustain the latch-up condition. A simple but satisfactory current limiter is a resistor in series between the power supply and the power input of the CMOS integrated circuit and a capacitor connected across the power input and the ground connection to the integrated circuit. The capacitor provides sufficiently high peak currents to satisfy transient switching current requirements of the integrated circuit and the resistor limits the average current to less than that which would sustain the latch-up condition. Connection of low impedance input sources and output loads with the CMOS circuit must also be avoided. Any combinations of input and output leads, which are connected to transistor sources or drains in the CMOS circuit can also contribute to a latch-up condition. Unfortunately, output loads cannot always be arranged to be of a high impedance nature. For example, display devices and transmission lines are characteristically low impedance loads. Discrete or integrated bipolar circuits can be used as buffers between the MOS integrated circuit and low impedance loads, however this adds considerable expense.

A more economical solution has been found which involves a controlled current limiting circuit separately connected to the output gates in the integrated circuit. The controlled current limiting circuit is responsive to the voltage at the junction between the low AC impedance current limiter and the CMOS integrated circuit to switch to a high impedance when this voltage drops below a predetermined value. Hence when a latch-up condition is induced, the circuit returns to its normal operating condition after a momentary interruption in the current supplied from the controlled current limiting circuit.

An example embodiment of the invention will now be described with reference to the accompanying drawings in which.

Figure 1:
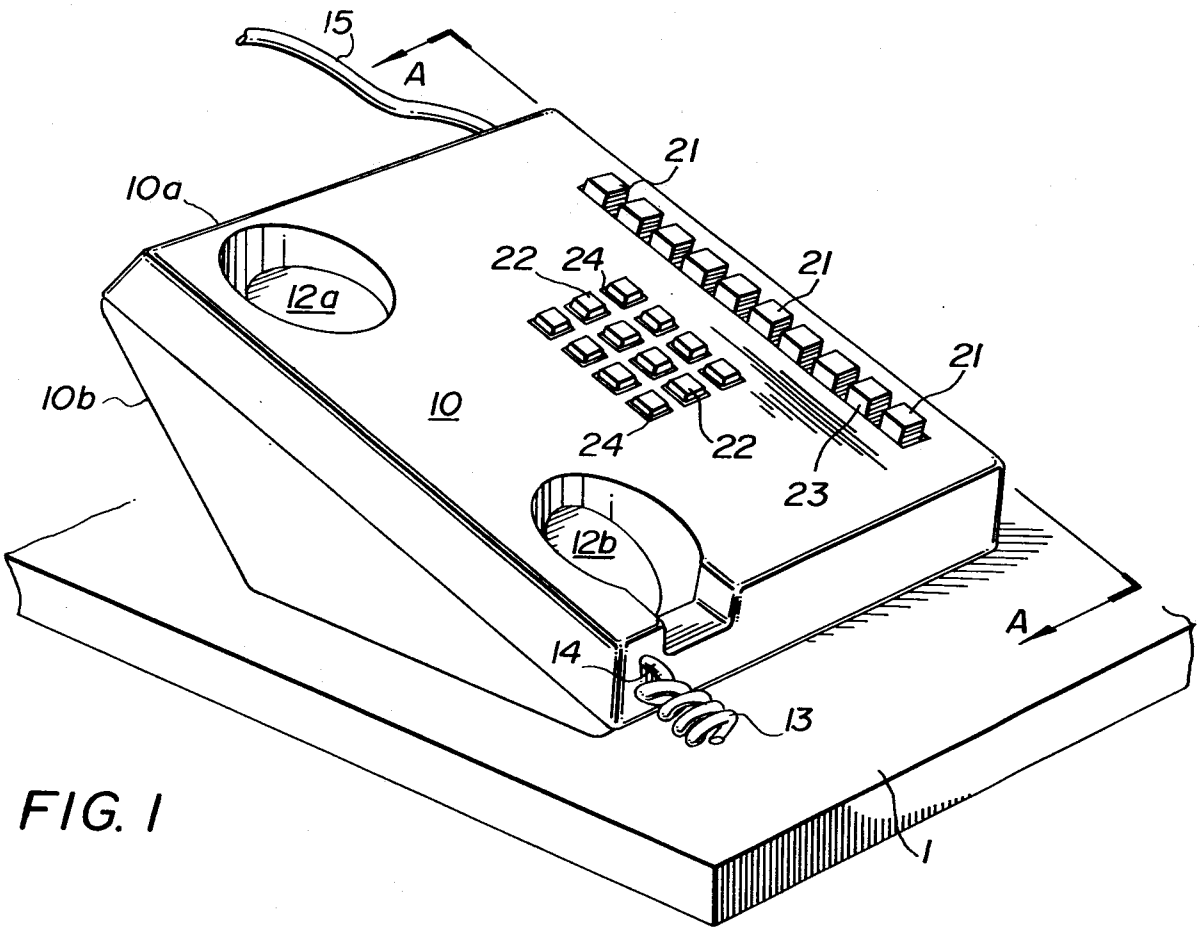
FIG. 1 is a pictorial view of a telecommunications terminal apparatus.
Figure 2:
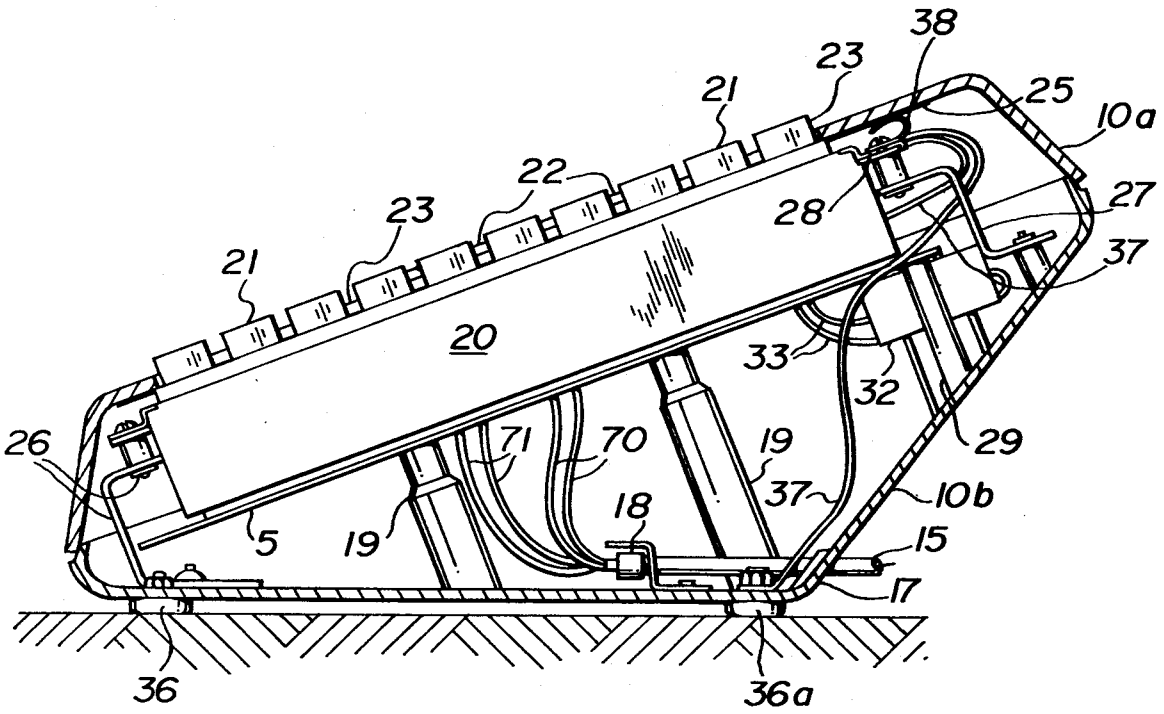
FIG. 2 is a cross-sectional side elevation taken along a line A—A in FIG. 1.

Referring to FIGS. 1 and 2, the terminal apparatus includes a housing 10 having a top portion 10*a*, carried by a base portion 10*b*. The base portion 10*b* is supported by feet 36 and a conductive foot 36*a* which rest upon a supporting surface 1, typically a desk or table top. A line cord 15, including at least tip and ring leads 70 enters the housing 10 via an orifice 17 in the base portion 10*b* and is retained by a retaining assembly 18 as shown in FIG. 2. A handset cord 13 enters the housing 10, as shown in FIG. 1, via an orifice 14 in the top portion 10*a*. Receptacles 12*a* and 12*b* in the top portion are for receiving a handset which is not shown. Pushbuttons 21 reside in an elongated aperture 23 in the top portion 10*a*. Dial pad pushbuttons 22 protrude through respective rectangular apertures 24 in the top portion 10*a*. With refence to FIG. 1, it is often the practice to provide an insert in the top portion 10*a*, the insert including the apertures 23 and 24 and being easily removeable to provide access to the interior of the housing 10. Such an arrangement is described in U.S. Pat. No. 3,838,229 issued on Sept. 24, 1974to R. J. Morrell et al.

In FIG. 2, control devices 20, which include pushbuttons 20 and 21, are carried by a circuit board 5. The circuit board 5 is supported on posts 19 extending from the base portion 10*b* and the control device 20 is held by retaining assemblies 26 and 27. The top portion 10*a* of the housing is typically formed from an insulating material, for example acrylonitrile butadene styrene (ABS). A portion of the inner surface of the top portion 10*a*, adjacent the apertures 23 and 24 is rendered electrically conductive by the application of a conductive layer 25. For example, this can be in the form of a conductive foil glued to the surface or a conductive paint applied to the surface. A condutive paint known as Eccocoat 257 and manufactured by Emerson and Cuming Inc., of Canton, Mass. has been found satisfactory when sprayed onto the surface. A screw fastener 28, part of the retaining assembly 27, also functions as a terminal post to retain a conductive spring member 38. The spring member 38 simplifies assembly of the top portion 10*a* with the base portion 10*b*. In an assembled terminal apparatus, the spring member 38 connects the conductive surface 25 to the conductive foot 36*a* via a lead 37. A capacitor 32 is fixed to the base portion 10*b* by a mounting assembly 289 and capacitor leads 33 connect the capacitor 32 to the circuit board 5.

Figure 3:
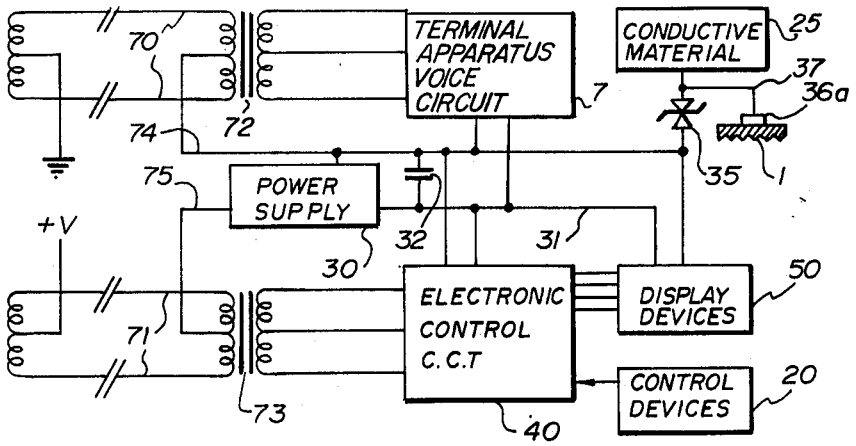
FIG. 3 is a block circuit diagram of the telecommunications terminal apparatus in FIG. 1.

Referring to FIG. 3, a terminal apparatus voice circuit 7 is connected to a transmission facility having tip and ring leads 70 via a hybrid transformer 72. An electronic control circuit 40 is connected to a transmission facility 71 via a hybrid transformer 73. Power and earth connections from the transmission facilities 70 and 71 are supplied to the terminal apparatus via centertap connections on the hybrid transformers 72 and 73. A power supply 30, display devices 50, the electronic control circuit 40 and the voice circuit 7 are each connected to ground by a lead 74. The power supply 30 receives energizing current from the transmission facility 71 via a lead 75. Power from the power supply 30 is connected to the remaining elements in the terminal apparatus via a lead 31. The capacitor 32 is connected between the leads 31 and 74. The control devices 20, previously described with reference to FIG. 2, are connected to the electronic control circuit 40. Display devices 50 are connected to the electronic control circuit 40 and the power supply 30.

Referring to FIGS. 2 and 3, the voice circuit 7, the electronic control circuit 40, the hybrid transformers 72 and 73, the power supply 30, display devices 50 and a pair of back to back zener diodes 35 are all carried by the circuit board 5. The zener diodes 35 are connected between the lead 74 and the conductive material 25 via the spring member 38. The display devices 50 are housed in the pushbuttons 21.

In operation, the terminal apparatus (FIGS. 1 – 3) is connected to a transmission facility, for example a voice loop circuit having tip and ring leads 70 and a similar facility 71 for carrying data signals. One such transmission facility is disclosed by K. Korver in U.S. Pat. No. 3,936,602 issued on Feb. 3, 1976, entitled "Full Duplex Data Transmission System Using Two Speeds of Diphase Signal for Simplified Sync." A user approaching the terminal may or may not carry a significant static charge. If the user is charged, this charge will be conducted as a discharge current through some part or parts of the terminal apparatus just as the user is making initial contact with the apparatus. If the user elects to grasp the handset, most of the discharge will find its way through the voice circuit to the transmission facility or through the handset cord insulation to the table surface. If the user elects to actuate one of the pushbuttons 21 or 22, the discharge is transmitted via the conductive material 25 to the pair of back to back zener diodes 35 and/or to the conductive foot 36*a* and the supporting surface 1. The zener diodes 35 are used to isolate the transmission facility from the conductive surface 25 and the supporting surface 1 during normal operation. Depending upon the polarity of the charge, one of the zener diodes is oriented for forward conduction while the other zener diode is oriented for zener operation. As the static voltage is impressed upon the zener diodes 35, the diodes conduct to provide a low impedance path to the transmission facility 20 via the lead 74. Other devices may be substituted for the zener diodes 35; for example, some PNPN switching diodes are well suited for this application.

In a typical installation, the distance between the ground connections at the remote end of the transmission facility 70 is too distant to provide an effective sink for static discharge at the terminal apparatus. As the transmission facility between the terminal apparatus is typically a twisted pair of wires having relatively low insulation requirements, a static discharge impressed on one end of the transmission facility will travel along the pair only so far as the first nearby earth which is sufficiently close to cause a discharge. Such discharge will often occur directly through the insulation on one or both wires of the twisted pair.

The protection against static discharge as described above can be equally well applied in any situation where a power source associated with an earth ground supplies operating current to the terminal apparatus. For example, power could be derived directly from a connection to an electric utility supply or derived solely from the tip and ring leads of a transmission line. In an alternate arrangement to that shown in FIG. 3, the transmission lines 70 and 71 are supplied with power from balanced negative and positive supplies.

Figure 4:
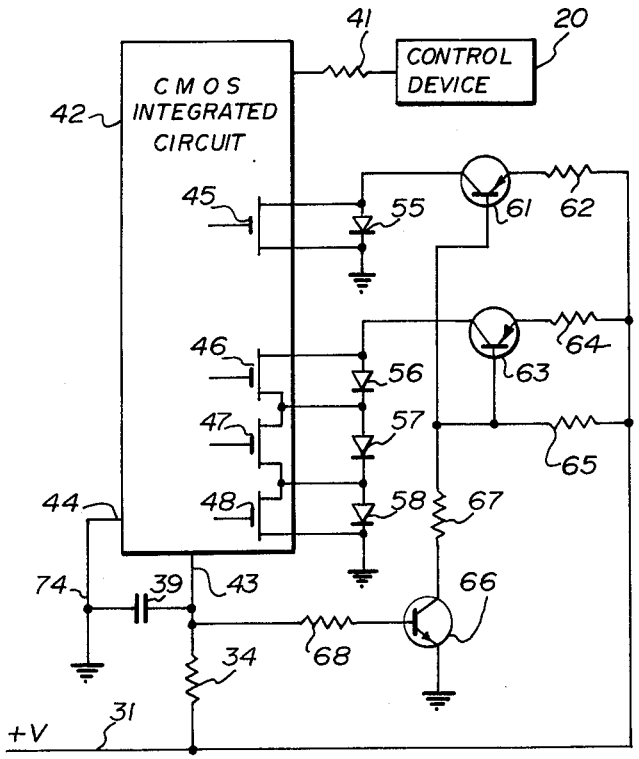
FIG. 4 is a schematic circuit diagram of part of FIG. 3.

In the situation where a portion of the electronic control circuit 40 includes a complementary metal oxide silicon (CMOS) integrated circuit 42 additional protection may be obtained by using the circuit illustrated in FIG. 4. One or more input connections to the CMOS circuit 42 are provided by one or more resistors 41. The CMOS circuit 42 includes a plurality of integrated output gates 45 - 48, which are MOS field effect transistors (MOSFETs) having source, drain and gate electrodes. The display devices in this example embodiment are light emitting diodes (LEDs) 55 - 58. Bipolar transistors 61, 63 and 66 and resistors 62, 64, 65, 67 and 68 are connected to provide two controlled impedance power supplies. The CMOS circuit 42 includes a bulk of control circuitry, not shown, which is supplied with power and ground via terminals 43 and 44 respectively. A resistor 34 is connected between the voltage lead 31 and the power terminal 43 and a capacitor 39 is connected between the power and ground terminals 43 and 44.

CMOS integrated circuits are very sensitive to nearby static discharges, as for example will occur from time to time through the protection circuitry illustrated in the terminal apparatus in FIGS. 1 - 3. A static discharge may well initiate a latch-up condition in the integrated CMOS circuit 42. However, as the sustaining latch-up current requirement is quite high relative to the normal operating current of the CMOS circuit 42, the value of resistor 34 is chosen such that it has little effect upon the average operating voltage supplied to the CMOS integrated circuit 42 but such as to limit the current from the lead 31 so that latch-up current cannot be sustained at the power teriminal 44. The capacitor 39 supplies the peak current required during switching transients which occur during the normal operation of the CMOS circuit 42 but is quickly drained by the circuit should a latch-up condition begin to occur. For example, where the CMOS circuit 42 requires a normal operating current of about 0.1mA, a resistor 34 having a resistance of 1 KΩ and a capacitor 39 having a capacitance of 22μf have been found satisfactory.

The MOSFETs 45 - 48 are connected across the LEDs 55 - 58 respectively. As the LEDs are by nature low impedance devices, substantial current, relative that required by CMOS gates, is required for their operation. The operating current for the LED 55 is supplied from the voltage lead 31 via the resistor 62 and the transistor 61. The LED 55 emits light when the MOSFET 45 is OFF and is extinguished when the MOSFET 45 is ON providing an alternate path for the operating current. Likewise, the LEDs 56 - 58 are each controlled according to the state of its associated MOSFET. Operating current for the LEDs 56 - 58 is supplied from the voltage lead 31 via the resistor 64 and the transistor 63. Base current required to maintain the transistors 61 and 63 in an ON condition is supplied via the transistor 66 and the resistor 67. This current is divided between the bases of the transistors 61 and 63 and the resistor 65. In turn the transistor 66 is maintained ON with base current supplied to it via the resistors 34 and 68.

In the event that a latch-up condition should begin to occur, the CMOS integrated circuit 42 draws sufficient current from its power terminal 43 to interrupt the base current to the transistor 66. This causes the base current to the transistors 61 and 63 to be interrupted and effectively disconnects the LEDs 55 - 58 and the MOSFETs 45 - 48 from the voltage lead 31. Hence there is insufficient current available to the CMOS circuit 42 for a latch-up condition to be maintained. As the latch-up condition is not maintained, the current drawn at the power terminal 43 diminishes to a more normal level. This causes the normal operating voltage to be restored at the power terminal 43 and the transistor 66 base current to be restored. The transistor 66 again draws current from the bases of the transistor 61 and 63 and the circuit operation restored to normal as described in the preceding paragraph.

What is claimed is:

1. In a telecommunications terminal apparatus including a housing having an aperture defined by a peripheral wall, and in the housing at least one manually actuatable control protruding into the aperture, a power supply for connection to a source of energizing current related to earth, and electronic circuitry having power and control terminals connected to the power supply and the actuatable control respectively, the electronic circuitry being susceptible to being damaged by static electric discharge from a user; an electrical circuit for reduding exposure of the electronic circuitry to said static electric discharge, the electrical circuit comprising an electrically conductive material located in close proximity to the actuatable control and the aperture, and a conductive path connected between the conductive material and one of the power terminals, whereby static electric discharge which would typically flow along a potentially damaging path through the actuatable control and the electronic circuitry, is conducted around the electronic circuitry via the conductive material and the conductive path.

2. A telecommunications terminal apparatus as defined in claim 1, in which the housing is adapted to rest upon a supporting surface, and wherein the electrical circuit further comprises at least one electrically conductive member for contacting the supporting surface, the conductive member being connected to the conductive path.

3. A telecommunications terminal apparatus as defined in claim 2 in which a bidirectional variable impedance means is connected in series between the power terminal and the conductive path, the impedance means having high and lower impedance characteristics and being responsive to a substantial electrical potential difference between the conductive path and the power terminal to switch from the high to the lower impedance characteristic to provide a low impedance connection between the conductive path and the power terminal, the impedance means otherwise substantially isolating the conductive path from the power terminal.

4. A telecommunications terminal apparatus as defined in claim 1 in which the electronic circuitry comprises:

a CMOS integrated circuit having output, voltage and ground terminals and a switch means associated with at least two of the output terminals;

current limiting means, having a low AC impedance characteristic and being connected between a power terminal of the electronic circuitry and the voltage terminal of the CMOS integrated circuit for limiting the average current to the voltage terminal to less than that which can sustain a latch-up condition in the CMOS integrated circuit;

a current limiter circuit connected between the power terminal of the electronic circuitry and one of said two output terminals, the current limiter being responsive to the operating voltage at the voltage terminal to permit a predetermined current flow to said one output terminal and to voltages at the voltage terminal being substantially lower than the operating voltage to inhibit current flow to said one output terminal;

whereby in the event of an induced latch-up condition being initiated there is insufficient current available at the voltage and output terminals to sustain the latch-up condition.

5. A telecommunications terminal apparatus for connection to a transmission facility which includes a source of energizing power related to earth, the terminal apparatus comprising:

a housing having wall portions defining an interior cavity and in a wall portion of the housing at least one aperture defined by a peripheral wall having an electrically conductive surface;

a power supply having input terminals for connection to the transmission facility and an output terminal, the power supply being responsive to energizing power from the transmission facility to generate an operating voltage at its output terminal;

electronic circuitry having a power input connected to the output terminal of the power supply, and a control input;

control means connected to the control input and including a manually actuatable member accessible to a user via said aperture;

a bidirectional variable impedance means having two terminals, one terminal connected to the electrically conductive surface and the other terminal for connection to the transmission facility, the impedance means having high and lower impedance characteristics and being responsive to a substantial electrical potential difference between the electrically conductive surface and the transmission facility to swith from the high to the lower impedance characteristic, whereby a static electric discharge from a user is substantially conducted around the electronic circuitry via the electrically conductive surface and the impedance means.

6. A telecommunications terminal apparatus as defined in claim 5, in which the housing includes a base portion adapted to rest upon a supporting surface, the apparatus further comprising:

at least one electrically conductive member carried by the base portion of the housing for contacting the supporting surface;

a conductor means connected between the electrically conductive surface and the electrically conductive member.

7. A telecommunications terminal apparatus as defined in claim 6, in which the housing includes a top portion carried by and detachable from the base portion, said aperture residing in the top portion, the electrically conductive surface extending along a portion of the inner wall surface of the top portion of the housing, and in which the conductor means includes an electrically conductive spring member secured to the base portion and adapted to resiliently contact the electrically conductive surface on the top portion.

8. A telecommunications terminal apparatus as defined in claim 5, in which the housing furthe comprises a base portion and a top portion, said aperture residing in the top portion, the power supply and the bidirectional variable impedance means being carried by the base portion, and in which the electrically conductive surface extends along a portion of the inner wall surface of the top portion, the terminal apparatus further comprising:

an electrically conductive spring member secured to the base portion for resiliently contacting the electrically conductive surface on the top portion, the conductive spring member providing for connection of the impedance means with the electrically conductive surface.

9. A telecommunications terminal apparatus as defined in claim 5, in which the electronic circuitry comprises:

a CMOS integrated circuit having output, voltage and ground terminals and a switch means associated with at least two of the output terminals;

current limiting means, having a low AC impedance characteristic and being connected between the power terminal of the electronic circuitry and the voltage terminal of the CMOS integrated circuit for limiting the average current at the voltage terminal to less than that which can sustain a latch-up condition in the CMOS integrated circuit;

a current limiter circuit connected between the power terminal of the electronic circuitry and one of said two output terminals, the current limiter being responsive to the operating voltage at the voltage terminal to permit a predetermined current flow to said one output terminal and to voltages at the voltage terminal being substantially lower than the operating voltage to inhibit current flow to said one output terminal;

whereby in the event of an induced latch-up condition being initiated there is insufficient current available at the voltage and output terminals to sustain the latch-up condition.

* * * * *